US006984111B2

(12) United States Patent
Kitazume

(10) Patent No.: US 6,984,111 B2
(45) Date of Patent: Jan. 10, 2006

(54) MULTIBLADE BLOWER

(75) Inventor: Michio Kitazume, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/622,463

(22) Filed: Jul. 21, 2003

(65) Prior Publication Data

US 2004/0105757 A1 Jun. 3, 2004

(30) Foreign Application Priority Data

Jul. 24, 2002 (JP) ..... 2002-215490

(51) Int. Cl.
*F04D 29/22* (2006.01)

(52) U.S. Cl. ..... 416/175; 416/203; 416/183

(58) Field of Classification Search ..... 416/175, 416/183, 185, 187, 188, 198.1, 203

See application file for complete search history.

(56) References Cited

U.S. PATENT DOCUMENTS 4,900,228 A * 2/1990 Yapp ..... 416/183
6,139,273 A * 10/2000 Schwarz et al. ..... 416/185

FOREIGN PATENT DOCUMENTS

JP 60156997 8/1985

* cited by examiner

*Primary Examiner*—Edward K. Look
*Assistant Examiner*—Richard A. Edgar
(74) *Attorney, Agent, or Firm*—Baker Botts L.L.P.

(57) ABSTRACT

Air flows along pressure surfaces and suction surfaces of main blades of an inner blade group by rotation of an impeller. When the air passes the inner blade group, the air flowing along the suction surfaces of the main blades tends to separate from the suction surfaces, and shearing flows tend to be formed behind outer diameter end portions of the main blades. Here, the auxiliary blades of the outer blade group are placed inside the air flows passing between the main blades of the inner blade group, and therefore the auxiliary blades restrain the separation of air flows, and the shearing flows.

8 Claims, 4 Drawing Sheets

PRIOR ART

MULTIBLADE BLOWER

BACKGROUND OF THE INVENTION

1. Field of the Invention

The present invention relates to a multiblade blower installed in an air conditioning system for a vehicle, and the like.

2. Description of the Related Art

A multiblade blower includes an impeller having a plurality of blades placed circumferentially around a rotation shaft, and when the impeller is rotated, air is taken in from a side of an inner diameter end portion of the blade, and is discharged from a side of an outer diameter end portion thereof. A blower performance such as air blowing ability and noise of the multiblade blower is influenced by the shapes of the blades and the shape of a casing for housing the impeller, and the like. Since the length in an air flowing direction of each of the blades is short in the multiblade blower, an air flow flowing along the blade is difficult to form, and a vortex flow occurs due to separation of the air flow. This vortex flow reduces the air blowing ability, and is a main cause of the noise.

In order to solve the above problems, the applicant filed the application of the multiblade blower shown in FIG. 5 and FIG. 6 (Japanese Patent Application No. 2001-384139). FIG. 5 shows an impeller 1 of the multiblade blower, and FIG. 6 shows blades 2 section encircled by the alternate long and short dash line in FIG. 5.

The impeller 1 includes a number of blades 2 circumferentially with a central rotation shaft as its center as shown in FIG. 5, and when the blades 2 rotate around the rotation shaft, air is taken in from sides of inner diameter end portions 2*a* of the blades 2 and is discharged from sides of outer diameter end portions 2*b*.

Here, the blade 2 is in a wing shape at the side of the inner diameter end portion 2*a* (a front half part of the blade 2). Namely, it is in a shape in which the thickness of the blade gradually increases once, and thereafter, gradually decreases. The shape of the front half part of the blade 2 restrains disturbance of an air flow. The thickness of the blade 2 at the side of the outer diameter end portion 2*b* (a rear half part of the blade 2) is substantially uniform and linear. Due to this, the separation of air at the rear half part of the blade 2 is restrained, and occurrence of a vortex flow at the wake flow behind the blade 2 is restrained.

However, in the multiblade blower described in the aforementioned application, the outer diameter end portion 2*b* of each of the adjacent blades 2 is placed to be somewhat spaced from each other, and therefore as shown in FIG. 6, there arises the possibility that air flowing to a suction surface of the outer diameter end portion 2*b* is deviated to a pressure surface of the other adjacent blade 2 to form a shearing flow 3 behind the blade 2.

In order to solve the above-described problems, a method for forcefully restraining a deviating flow of air by forming a space between the outer diameter end portions 2*b* of the adjacent blades 2 to be small can be considered.

However, pressure recovery becomes insufficient by the increase in relative velocity of air flowing between the outer diameter end portions 2*b*, and there is the possibility that air blowing performance and noise property are reduced at operating points with high pressure loss.

SUMMARY OF THE INVENTION

In consideration of the problems of the aforementioned prior art, an object of the present invention is to provide a multiblade blower capable of improving air blowing performance and reducing noise by placing a plurality of kinds of blades outside and inside.

In order to solve the aforementioned problems, the present invention is a multiblade blower including an impeller having a plurality of blades placed circumferentially, and taking in air from a side of an inner diameter end portion of each of the blades and discharging the air from a side of an outer diameter end portion of each of the blades by rotation of the impeller, and has a structure in which two or more of blade groups in each of which said blades are placed in a ring shape are placed at least in a diameter direction inside and outside, and each blade of the outer blade group out of the blade groups is placed inside an air flow passing between blades of the inner blade group.

Air flows along pressure surfaces and suction surfaces of the inner blade group by rotation of the impeller. When air passing through the inner blade group, air flowing along the suction surfaces of the blades tends to separate from the suction surfaces, and shearing flows tend to be formed behind the outer diameter end portions of the blades.

Concerning this, the blades of the outer blade group according to the present invention are placed inside air flows passing between the blades of the inner blade group, and therefore the blades of the outer blade group can change the flows of the air so as to avoid separation of the air flow, and the shearing flows.

The aforementioned object and the other objects, the characteristics, and the advantages of the present invention will be made apparent by the following explanation and the attached drawings.

DESCRIPTION OF THE PREFERRED EMBODIMENTS

Figure 1:
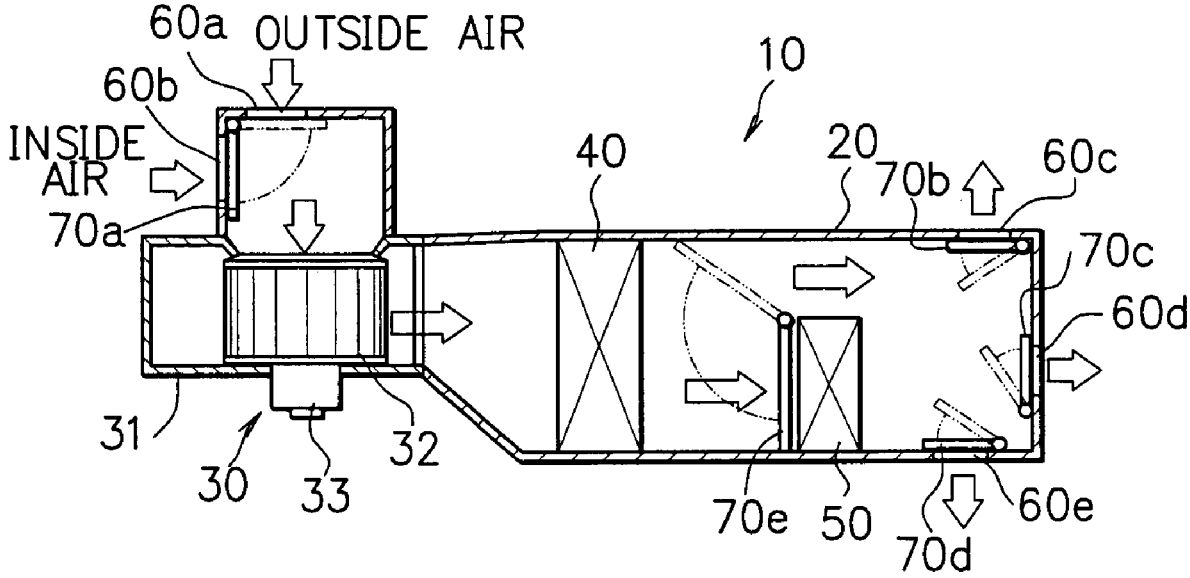
FIG. 1 is a schematic sectional view of an air conditioning system for a vehicle.

FIG. 1 to FIG. 4 show an embodiment of a multiblade blower according to the present invention.

On explaining the multiblade blower according to the present invention, an outline of an air conditioning system for a vehicle loaded with the multiblade blower will be explained first with reference to FIG. 1.

An air conditioning system 10 for a vehicle has an air conditioning duct 20 for guiding a conditioning air. From an upwind side to a leeward side in the air conditioning duct 20, a multiblade blower 30, an evaporator 40 being a component of a refrigeration circuit, and a heater core 50, to which warm water is supplied from a radiator, are placed in order.

An outside air intake port 60*a* and an inside air intake port 60*b* are provided at the upwind side of the air conditioning duct 20. An upward air outlet port 60*c* for defrosting, an upper air outlet port 60*d* for blowing air toward a chest of a passenger, and a foot air blowing port 60*e* for blowing air to feet of the passenger are provided at a leeward side of the air conditioning duct 20. The ports 60*a* to 60*e* are controlled by dampers 70*a* to 70*d*. Further, a ventilation amount to the heater core 50 is controlled by an air mix damper 70*e*.

When an inside of a cabin is cooled, the multiblade blower 30 is driven. Due to this, inside air or outside air passes through the evaporator 40 in which a refrigerant flows. The air passing through the evaporator 40 is cooled by the evaporator 40, and cold air is generated. The cold air is blown into the cabin through at least one of the outlet ports 60*c* to 60*e* to cool the inside of the cabin. On the other hand, the multiblade blower 30 is also driven when the inside the cabin is heated. Due to this, the inside air or the outside air passes through the heater core 50 in which a warm water flows. The air passing through the heater core 50 is heated by the heater core 50, and warm air is generated. The warm air is blown into the cabin through at least one of the outlet ports 60*c* to 60*e*, and the inside of the cabin is warmed. It should be noted that the outlined arrows in FIG. 1 show the flow of the air.

Incidentally, the air conditioning duct 20 for an automobile cannot be made large from the relationship with the vehicle body, and following this, the multiblade blower 30 cannot help becoming compact, but in order to air-condition the inside of the cabin reliably even with the compact blower, the multiblade blower with high air blowing performance is demanded. In addition, the one with less noise is demanded to keep the inside of the cabin quiet.

In order to meet the above demands, the multiblade blower 30 according to the present embodiment adopts the following structure.

Figure 2:
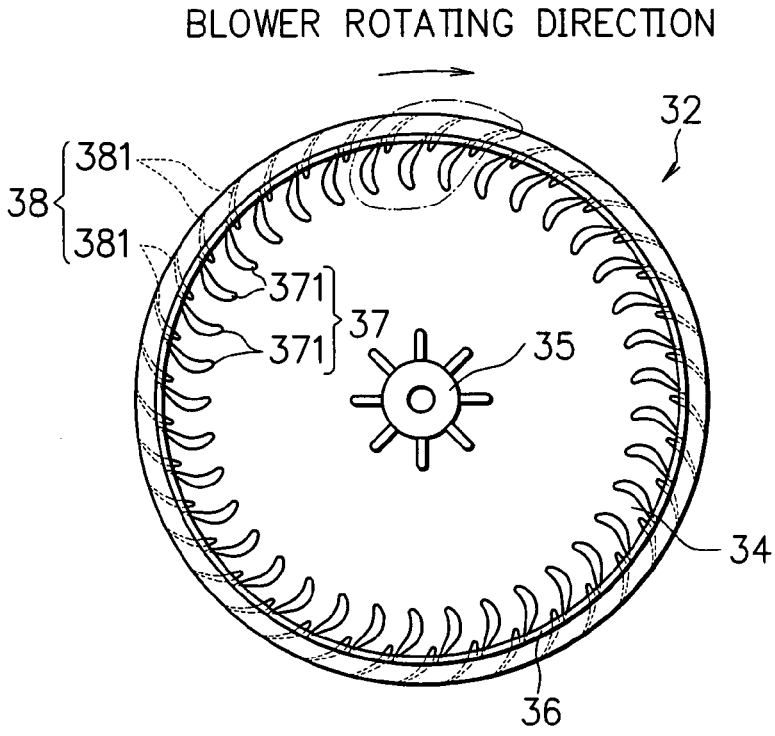
FIG. 2 is a front view of an impeller of a multiblade blower according to the present invention.
Figure 3:
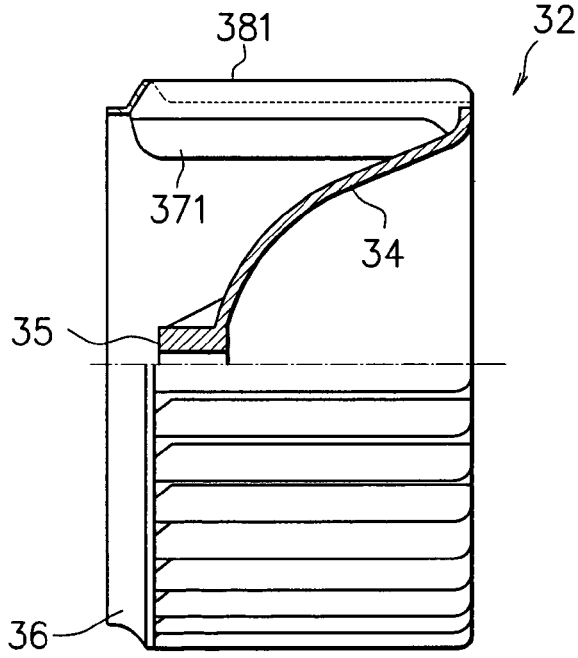
FIG. 3 is a partial sectional side view of the impeller of the multiblade blower according to the present invention.

The multiblade blower 30 has an impeller 32 housed in a scroll 31 as shown in FIG. 1. The impeller 32 is driven by an electric motor 33. The impeller 32 is integrally formed of a resin. The impeller 32 has a drive plate 34 expanded toward an air intake side, and a rotation shaft (not shown) of an electric motor 33 is connected to a boss part 35 at a center of the drive plate 34, as shown in FIG. 2 and FIG. 3. Two kinds of blade groups 37 and 38 are fixed between an edge of the drive plate 34 and a connecting ring 36 of an edge of an air intake side. The blade groups 37 and 38 are placed inside and outside with the rotation shaft as a center. The inner blade group 37 is constructed by large main blades 371 for taking in the inside and outside air. The outer blade group 38 is constructed by small auxiliary blades 381 for changing the flow of air taken in by the main blades 371.

Figure 4:
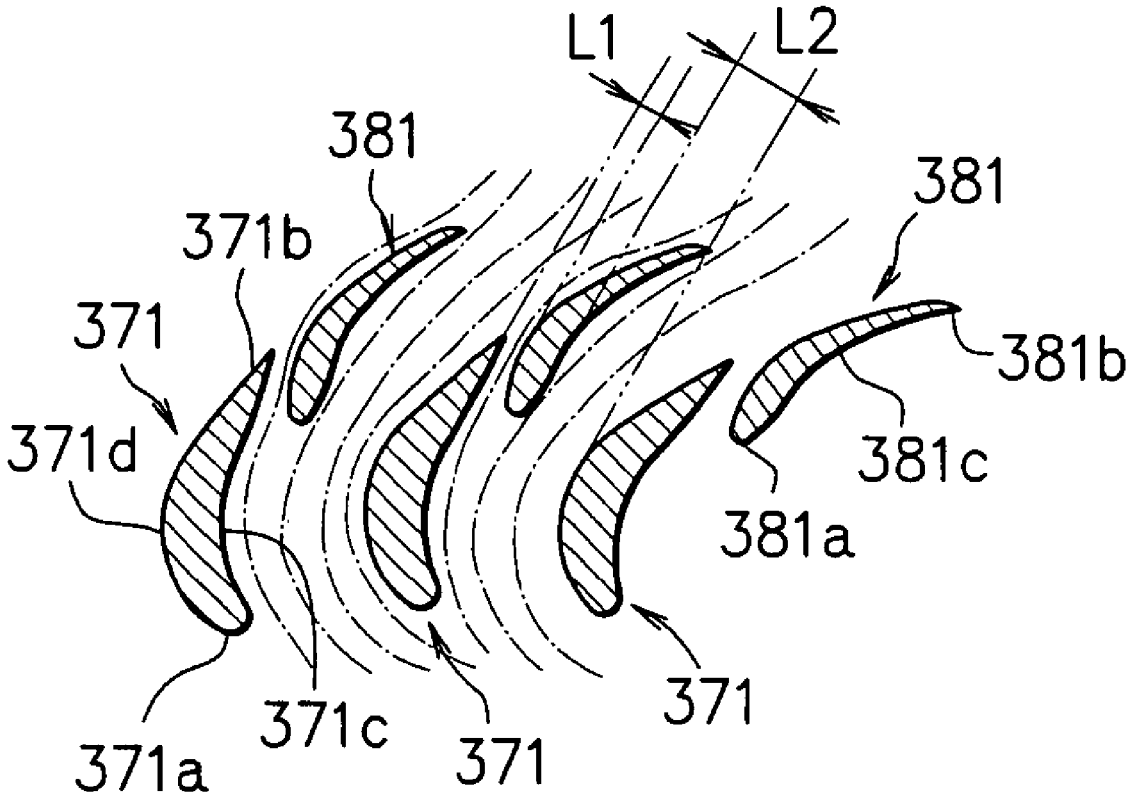
FIG. 4 is a sectional view showing air flows at main blades and auxiliary blades according to the present invention.
Figure 5:
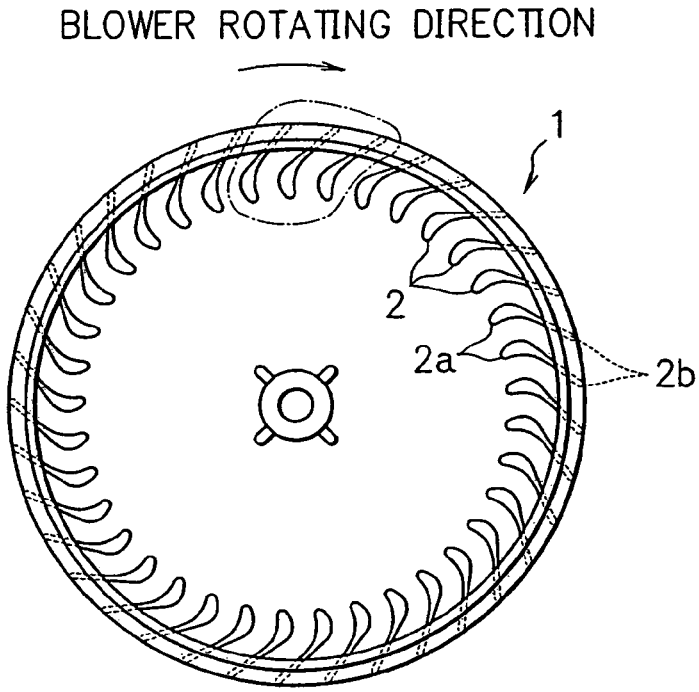
FIG. 5 is a front view of an impeller of a conventional multiblade blower.
Figure 6:
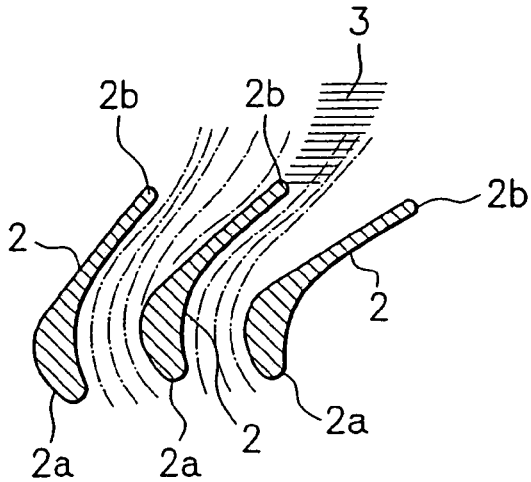
PRIOR ART F I G. 6
FIG. 6 is a sectional view showing air flows at a blades section of the conventional multiblade blower.

The main blade 371 and the auxiliary blade 381 are in a wing shape which once gradually increases and thereafter gradually decreases in the blade thickness as shown in FIG. 4. The main blade 371 is larger than the auxiliary blade 381 in the blade thickness, and the warpage of the main blade 371 is larger than that of the auxiliary blade 381. The main blade 371 is larger than the auxiliary blade 381 in chord length, whereby the intake ability of the main blade 371 is higher than the intake ability of the auxiliary blade 381.

The main blades 371 and the auxiliary blades 381 constructed as above are placed as shown in FIG. 4. Namely, each of the auxiliary blades 381 is placed inside the air flow passing between the adjacent main blades 371.

Describing this in detail, as shown in FIG. 4, an inner diameter end portion 381*a* of each of the auxiliary blade 381 is placed between a pressure surface 371*c* of an outer diameter end portion 371*b* of one of the adjacent main blades 371 and a suction surface 371*d* of the other main blade 371, and an outer diameter end portion 381*b* is extended rearward. A space L1 between the inner diameter end portion 381*a* of each of the auxiliary blades 381 and the pressure surface 371*c* of one of the main blade 371 is smaller than a space L2 between the inner diameter end portion 381*a* of each of the auxiliary blades 381 and the suction surface 371*d* of the other main blade 371.

When the multiblade blower 30 is driven, air is taken in from the side of the inner diameter end portion 371*a* of the main blade 371, and the air flows along the pressure surface 371*c* and the suction surface 371*d* of the main blade 371. When the air flows between the adjacent main blades 371, the air flowing along the suction surface 371*d* of the main blade 371 generally tends to separate from the suction surface 371*d*, and a shearing flow tends to be formed behind the outer diameter end portion 371*b* of the main blade 371.

On the other hand, in the present embodiment, the inner diameter end portion 381*a* of the auxiliary blade 381 is placed between the pressure surface 371*c* of the outer diameter end portion 371*b* of one of the adjacent main blades 371 and the suction surface 371*d* of the other main blade 371 as described above, and therefore the auxiliary blade 381 can change the flow of air so as to avoid separation of the air flow, and the shearing flow.

In the present embodiment, the space L1 between the inner diameter end portion 381*a* of each of the auxiliary blades 381 and the pressure surface 371*c* of one of the main blades 371 is made smaller than the space L2 between the inner diameter end portion 381*a* and the suction surface 371*d* of the other main blade 371. As a result, part of the air flowing to the pressure surface 371*c* of the one of the adjacent main blade 371 is guided along the pressure surface 381*c* of the auxiliary blade 381 toward the suction surface 371*d* of the other of the main blades 371. Accordingly, separation of the air flow at the suction surface 371*d* of the main blade 371 and the shearing flow behind the main blade 371 are further restrained.

Since the separation of the air flow and the shearing flow are restrained in the multiblade blower 30 according to the present embodiment as described above, occurrence of a vortex flow is restrained, and air blowing performance and noise property are improved.

The aforementioned embodiment is constructed by the two kinds of blade groups that are the inner blade group 37 and the outer blade group 38, but three kinds or more of blade groups may be placed inside and outside to improve the air blowing performance and noise property. In the aforementioned embodiment, the auxiliary blade 381 is placed between the main blades 371, but it may be placed behind the main blade 371 depending on the wing shape of the main blade 371. Further, in the aforementioned embodiment, both of the main blade 371 and the auxiliary blade 381 are in the wing shapes, but the blade or the blades formed to have substantially uniform thickness may be adopted for one or both of them.

What is claimed is:

1. A multiblade blower, comprising an impeller having a plurality of blades placed circumferentially, and taking in air from a side of an inner diameter end portion of each of the blades and discharging the air from a side of an outer diameter end portion of each of the blades by rotation of the impeller, wherein two or more of blade groups, in each of which said blades are placed in a ring shape, are placed, such that the blades of an outer blade group are between and extend beyond at least one inner blade group at least in a radial direction, and each blade of the outermost blade group is placed inside air flows passing between blades of the at least one inner blade group;

wherein said at least one inner blade group comprises a plurality of main blades and said outer blade group comprises a plurality of auxiliary blades, and an inner diameter end portion of each of the auxiliary blades is placed between a pressure surface of an outer diameter end portion of one of the adjacent main blades and a suction surface of the other main blade and wherein a thickness dimension measured substantially perpendicular to the chord of said main blade is larger than a thickness dimension measured substantially perpendicular to the chord of said auxiliary blade.

2. The multiblade blower according to claim 1, wherein a space between the inner diameter end portion of each of the auxiliary blade and the pressure surface of one of the main blades is made smaller than a space between the inner diameter end portion of each of the auxiliary blades and the suction surface of the other main blade.

3. The multiblade blower according to claim 2, wherein said each blade is in a wing shape in a cross-section.

4. The multiblade blower according to claim 3, wherein said impeller is integrally formed of a resin.

5. The multiblade blower according to claim 4, wherein the warpage of said main blade is larger than the warpage of said auxiliary blade.

6. The multiblade blower according to claim 5, wherein a chord length of said main blade is larger than a chord length of said auxiliary blade.

7. A multiblade blower, comprising an impeller having a plurality of blades placed circumferentially, and taking in air from a side of an inner diameter end portion of each of the blades and discharging the air from a side of an outer diameter end portion of each of the blades by rotation of the impeller, wherein two or more of blade groups, in each of which said blades are placed in a ring shape, are placed, such that the blades of an outer blade group are behind and extend beyond at least one inner blade group at least in a radial direction, and each blade of the outermost blade group is placed inside air flows passing between blades of the at least one inner blade group;

wherein said inner blade group comprises a plurality of main blades and said outer blade group comprises a plurality of auxiliary blades;

wherein said each blade is in a wing shape in a cross-section;

wherein the warpage of said main blade is larger than the warpage of said auxiliary blade;

wherein a chord length of said main blade is larger than a chord length of said auxiliary blade; and wherein a thickness dimension measured substantially perpendicular to the chord of said main blade is larger than a thickness dimension measured substantially perpendicular to the chord of said auxiliary blade.

8. The multiblade blower according to claim 7, wherein said impeller is integrally formed of a resin.

* * * * *